US007540329B2

(12) United States Patent
Fay et al.

(10) Patent No.: US 7,540,329 B2
(45) Date of Patent: Jun. 2, 2009

(54) CASING COUPLER LINER HANGER MECHANISM

(75) Inventors: Peter J. Fay, Houston, TX (US); Gerald D. Lynde, Houston, TX (US); Edward J. O'Malley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 293 days.

(21) Appl. No.: 11/787,804

(22) Filed: Apr. 18, 2007

(65) Prior Publication Data

US 2008/0257561 A1 Oct. 23, 2008

(51) Int. Cl.
*E21B 23/00* (2006.01)
*E21B 43/10* (2006.01)

(52) U.S. Cl. ..... 166/382; 166/208; 166/216; 166/211; 166/217

(58) Field of Classification Search ..... 166/382, 166/208, 216, 211, 217
See application file for complete search history.

(56) References Cited

U.S. PATENT DOCUMENTS

| | | | | |
|---|---|---|---|---|
| 2,053,065 | A * | 9/1936 | Crowell | 166/210 |
| 2,427,330 | A | 9/1947 | Spencer | |
| 3,195,646 | A * | 7/1965 | Brown | 166/208 |
| 3,491,831 | A | 1/1970 | Dollison | |
| 4,295,523 | A | 10/1981 | Mott | |
| 4,307,781 | A | 12/1981 | Preston, Jr. et al. | |
| 4,310,048 | A | 1/1982 | Mott | |
| 4,497,368 | A * | 2/1985 | Baugh | 166/208 |
| 4,712,614 | A | 12/1987 | Allwin et al. | |
| 4,712,615 | A | 12/1987 | Dockins, Jr. et al. | |
| 5,311,941 | A | 5/1994 | Baugh | |
| 5,325,926 | A | 7/1994 | Lay et al. | |
| 5,327,964 | A | 7/1994 | O'Donnell et al. | |
| 5,579,829 | A | 12/1996 | Comeau et al. | |
| 6,568,471 | B1 | 5/2003 | Cook et al. | |
| 6,631,759 | B2 | 10/2003 | Cook et al. | |
| 6,705,395 | B2 | 3/2004 | Cook et al. | |
| 6,857,473 | B2 | 2/2005 | Cook et al. | |
| 7,114,573 | B2 | 10/2006 | Hirth et al. | |
| 2002/0100595 | A1 | 8/2002 | Cook et al. | |

(Continued)

FOREIGN PATENT DOCUMENTS

| | | |
|---|---|---|
| CN | 1064562 | 9/1992 |

(Continued)

*Primary Examiner*—Jennifer H Gay
*Assistant Examiner*—Yong-Suk Ro
(74) *Attorney, Agent, or Firm*—Greenberg Traurig LLP; Anthony F. Matheny

(57) ABSTRACT

A liner hanger has a housing with a pocket disposed on an inner wall surface and a slip slidingly engaged within the pocket. The liner hanger housing is secured in the string of casing. Both a setting mechanism and a liner engagement member are connected to the slips and are also located in the pocket. A releasable latching mechanism maintains the slips in the run-in position until the releasable latching mechanism is actuated. As the liner is moved through the casing coupler, the liner engagement member engages the liner through frictional force to cause the setting mechanism to move with the liner so that the latching mechanism can be disengaged and the slips can move axially downward. As the setting mechanism moves downward, the slips move radially inward and grip the liner.

20 Claims, 10 Drawing Sheets

U.S. PATENT DOCUMENTS

2003/0066655 A1 4/2003 Cook et al.
2003/0183396 A1* 10/2003 Adams et al. ..... 166/382
2004/0221997 A1 11/2004 Giroux et al.
2006/0185855 A1 8/2006 Jordan et al.
2006/0249285 A1 11/2006 Birckhead et al.
2008/0110643 A1 5/2008 Richard et al.
2008/0230233 A1* 9/2008 Fay et al. ..... 166/382

FOREIGN PATENT DOCUMENTS

CN 1021941 C 8/1993

* cited by examiner

CASING COUPLER LINER HANGER MECHANISM

BACKGROUND

1. Field of Invention

The invention is directed to couplers or collars having one or more axially movable slips disposed therein for connecting oil and gas well casing and for hanging a liner within the casing.

2. Description of Art

A liner is a tubular member that is usually run inside of wellbore casing of an oil or gas well and suspended within the wellbore casing. Liners are typically secured within a wellbore by toothed slips that are located on liner hangers. The slips are set by axially translating them with respect to the liner hanger mandrel or housing. As the slips are translated axially, they are cammed radially outward by a ramped surface that is fashioned into the mandrel. As the slips move radially outward, the toothed surfaces of the slip will bitingly engage the inner wall surface of the wellbore casing. This type of arrangement is shown, for example, in U.S. Pat. No. 4,497,368 in which slips are radially expanded by riding up over cone elements disposed into the tubular body of the central mandrel.

Actuation systems for such slips in the past employed full circumference hydraulically actuated pistons to move the slips. These designs presented a pressure rating problem in that the full circumference piston frequently had a maximum working pressure significantly lower than the mandrel which it surrounded. Thus, this type of design limited the maximum working pressure in the string to the rating of the cylindrical piston housing assembly. For example, it was not unusual in prior designs to have mandrels rated for 12,000 PSI while the surrounding cylinder housing for the cylindrical piston to only have a rating of approximately 3,000 PSI.

In an effort to improve the shortcoming of this design, another design illustrated in U.S. Pat. No. 5,417,288. was developed. In this design the mandrel body received a pair of bores straddling each of the slips. A piston assembly was mounted in each of the bores with all of the necessary seals. The application of hydraulic pressure in the mandrel into all the piston bores actuated the pistons on either side of each slip through a common sleeve to which all the slips were attached. This design, however, was expensive to manufacture, had many potential leak paths in the form of the ring seals on each of the pistons wherein each slip required two pistons.

On the other hand, this design provided for a higher pressure rating for the liner hanger body and also used the hydraulic pressure directly to actuate the slips. Necessarily, it did not include a locking feature against premature slip movements due to inadvertently applied pressures. The design in U.S. Pat. No. 5,417,288 also did not provide for flexibility for changed conditions downhole which could require additional force to set the slips. In essence, each application was designed for a pre-existing set of conditions with field variability not included as a feature of that prior art design.

These prior liner hangers also required use of devices and structures that increase the overall outer diameter of the liner hanger. Therefore, these liner hangers result in a reduction of usable diameter within the well. This is because the liner hanger is carried by the liner which requires the liner to be of a smaller diameter than the casing against which it is set or hung. The liner is then set within the annular space between the liner and the casing. Once set, the useable diameter of the well (i.e., the diameter through which production fluid can flow or tools can be passed) becomes the inner diameter of the liner. However, the components of the device securing the liner within the casing (including slips, elastomeric seals, setting sleeves and so forth) inherently occupy space between the liner and casing. For example, a wellbore having standard 21.40 lb. casing with an outer diameter of 5 inches, would have an inner diameter of 4.126 inches. It would be desirable to run into the casing a string of tubing, i.e., a liner, having an outer diameter of approximately 4 inches, which would allow for a liner with a large cross-section area for fluid flow and tool passage. However, the presence of the liner setting components on the outside of the liner will dictate that a smaller size liner or tubing string (such as 2⅞ inches) be run. Over an inch of diameter in usable area is lost due to the presence of both the liner and the liner setting device that is set within the space between the liner and the casing.

With respect to the slip assemblies, in the past those slip assemblies also have been configured in a variety of ways. In one configuration, when the slips are actuated, the load is passed through the slips circumferentially through their guides or retainers and transmission of the load to the underlying mandrel is avoided. In other more traditional designs, the slips are driven along tapered surfaces of a supporting cone and the loading that is placed on the supporting mandrel is in a radial direction toward its center, thus tending to deform the mandrel when setting the slips. Typical of such applications are U.S. Pat. Nos. 4,762,177, 4,711,326 and 5,086,845.

In another prior attempt, illustrated in U.S. Pat. No. 6,431,277, the liner hanger has an actuating piston that releases a mechanical latch that is restraining a set of springs. Once the latch is released, the springs set the slips. The liner hanger in this patent is also designed with a separate spring housing that restricts the total number of springs that can be used and is difficult to assemble. All of these prior slip assemblies are complex and, thus, expensive to manufacture.

Accordingly, prior to the development of the present invention, there has been no casing coupler or method of setting a liner hanger within a wellbore that: provides an easy to assemble liner hanger; provides a simple process for hanging the liner; provides an easily adaptable liner hanger for receiving different size and weight liners; and provides setting of a liner hanger inside a wellbore with little appreciable reduction in the useable area of the wellbore. Therefore, the art has sought a casing coupler and a method of setting a liner hanger within a wellbore that: provides an easy to assemble liner hanger; provides a simple process for hanging the liner; provides an easily adaptable liner hanger for receiving different size and weight liners; and provides setting of a liner hanger inside a wellbore with little appreciable reduction in the useable area of the wellbore.

SUMMARY OF INVENTION

Liner hanger mechanisms disclosed herein are directed to a coupler or collar for joining two pieces of oil or gas well casing. The coupler includes an enlarged inner diameter portion forming a pocket in the inner wall surface of the coupler. Slidingly engaged within the pocket is a slip. The slip includes a first end having a setting mechanism and a second end having a gripping member. The setting mechanism is releasably attached to the pocket by a latching mechanism.

In use, the coupler secures together two pieces of casing. The casing is then run into the wellbore to the desired depth. Although not required, the casing can then be cemented into place.

An inner tubing, or liner, such as production casing is then run into the casing. As the liner continues to be lowered within the casing, the setting mechanism engages the outer diameter of the liner such as through frictional force. After the liner is located within the casing at its desired location, the liner is lifted and/or rotated to unlatch the releasable latching mechanism. Due to the setting mechanism being unlatched, the liner can then be lowered through the casing causing the slip to slide downward and, thus, causing the gripping member to engage the liner and secure the liner within the casing.

Because the setting mechanism is located within the pocket portion of the casing coupler, the liner can be set or hung within the casing while saving useable cross-sectional area within the casing. In the instance of the 5 inch casing situation described above in the Background section, a liner having a four inch diameter could be run into the exterior casing.

The casing couplers and methods of setting a liner hanger within a wellbore have the advantages of: providing an easy to assemble and disassemble liner hanger; providing a simple process for hanging the liner; providing an easily adaptable liner hanger for receiving different size and weight liners; and providing setting of a liner hanger inside a wellbore with little appreciable reduction in the useable area of the wellbore.

In one aspect of the disclosure, one or more of the foregoing advantages may be achieved through a liner hanger for hanging a liner within a bore of a casing string. The liner hanger may comprise a housing for securing into the casing string at a desired location, the housing having an inner wall surface, the inner wall surface having a pocket disposed thereon; a slip disposed within the pocket, the slip having an inner gripping surface; a setting mechanism mounted to the slip, the slip being movable from an upper position fully recessed within the pocket to a lower position wherein the inner gripping surface protrudes inward from the pocket; and a liner engagement member mounted to the setting mechanism and protruding inward from the pocket, the liner engagement member frictionally engaging the liner as the liner is lowered through the setting mechanism causing the slip to move downward and inward to the lower position in engagement with the liner.

A further feature of the liner hanger is that the liner engagement member may comprise at least one bow spring having an inward bias. Another feature of the liner hanger is that the setting mechanism may comprise a tubular body having a helical thread matingly engaged with a pocket helical thread disposed on an inner wall surface of the pocket such that rotation of the liner rotates the setting mechanism to move the slip downward. An additional feature of the liner hanger is that the setting mechanism may comprise a releasable latching mechanism for retaining the setting mechanism in the upper position until the releasable latching mechanism is actuated to release the setting mechanism. Still another feature of the liner hanger is that the releasable latching mechanism may comprise a J-hook arrangement disposed between the setting mechanism and the pocket such that lifting and rotating the liner while the liner is engaged with the liner engagement member causes the J-hook arrangement to disengage. A further feature of the liner hanger is that the pocket may have a conical shoulder at its lower end, the slip sliding on the conical shoulder when moving form the upper to the lower position. Another feature of the liner hanger is that the liner hanger may further comprise a deformable connection member connected between the slip and the setting mechanism, the deformable connection member spacing the slip at a first distance from the setting mechanism while in the upper position and at a second distance that is shorter than the first distance while in the lower position. An additional feature of the liner hanger is that the liner hanger may further comprise a rotating member disposed at a lower end of the pocket, wherein the rotating member allows the liner to rotate when the slip is in the lower position.

In another aspect of the disclosure, one or more of the foregoing advantages may be achieved through a well. The well may comprise a string of casing cemented in the well; a housing secured in the string of casing, the housing having an annular pocket of greater inner diameter than an inner diameter of the string of casing, the pocket having a lower tapered end; a slip assembly carried in the pocket, the slip assembly having an initial position defining an inner diameter at least equal to the inner diameter of the casing, the slip assembly having an inner gripping surface; a setting mechanism mounted in the pocket to the slip assembly, the setting mechanism retaining the slip assembly in the initial position, the setting mechanism comprising a liner engagement member and a releasable latching mechanism, the liner engagement member defining an inner diameter less than the inner diameter of the casing, the releasable latching mechanism having an engaged position in which the slip assembly is unable to move downward and a disengaged position in which the slip assembly is permitted to move downward; a liner lowered into the casing, the liner being engaged with the liner engagement member through a frictional force sufficient, such that manipulation of the liner in a selected manner moves the releasable latching mechanism to the disengaged position, allowing the slip assembly to move downward with the liner to a set position on the tapered lower end with the inner gripping surface engaging the liner.

A further feature of the well is that the setting mechanism may comprise a tubular body having a helical thread disposed on an outer wall surface, the helical thread being matingly engaged with a pocket helical thread disposed on the inner wall surface the pocket, such that rotation of the liner in the selected manner rotates the setting mechanism to move the slip downward. Another feature of the well is that the releasable latching mechanism may comprise at least one J-hook for receiving at least one peg disposed circumferentially on an inner wall surface of the pocket, the releasable latching mechanism being actuated by lifting and rotating the liner in the selected manner while the liner is engaged with the liner engagement member. An additional feature of the well is that the releasable latching mechanism may comprise at least one peg matingly engageable with at least one J-hook disposed circumferentially on an inner wall surface of the pocket, the releasable latching mechanism being actuated by lifting and rotating the liner in the selected manner while the liner is engaged with the liner engagement member. Still another feature of the well is that the releasable latching mechanism may comprise a first J-hook matingly engageable with a second J-hook disposed circumferentially on an inner wall surface of the pocket, the releasable latching mechanism being actuated by lifting and rotating the liner in the selected manner while the liner is engaged with the liner engagement member. A further feature of the well is that the liner engagement member may comprise at least one bow spring having an inward bias.

In an additional aspect of the disclosure, one or more of the foregoing advantages may be achieved through a method of securing a liner within a bore of a casing string disposed in a wellbore. The method may comprise the steps of: (a) disposing within a wellbore at least two sections of casing secured together by a casing coupler to form the casing string, the casing coupler comprising a housing having a pocket disposed on an inner wall surface of the housing, the pocket having at least one slip, and a setting mechanism operatively associated with the slip; (b) lowering a liner into the bore of the casing string; (c) frictionally engaging an outer wall surface of the liner with the setting mechanism; then (d) lowering the liner causing the setting mechanism and the slip to move downward and the slip to move inward from the pocket until the slip engages an outer wall surface of the liner and, thus, secures the liner within the casing string of the wellbore.

A further feature of the method of securing a liner within a bore of a casing string disposed in a wellbore is that step (a) may comprise retaining the setting mechanism in an initial position; and after step (c) and before step (d), the liner may be manipulated in a selected manner to release the setting mechanism from the initial position. Another feature of the method of securing a liner within a bore of a casing string disposed in a wellbore is that manipulating the liner may comprise lifting the liner and rotating the liner an increment less than one 360 degree rotation. An additional feature of the method of securing a liner within a bore of a casing string disposed in a wellbore is that manipulating the liner may comprise rotating the liner less than 360 degrees. Still another feature of the method of securing a liner within a bore of a casing string disposed in a wellbore is that manipulating the liner may comprise rotating the liner more than 360 degrees. A further feature of the method of securing a liner within a bore of a casing string disposed in a wellbore is that the liner may be rotated two or more rotations, each rotation comprising 360 degrees.

Figure 1:
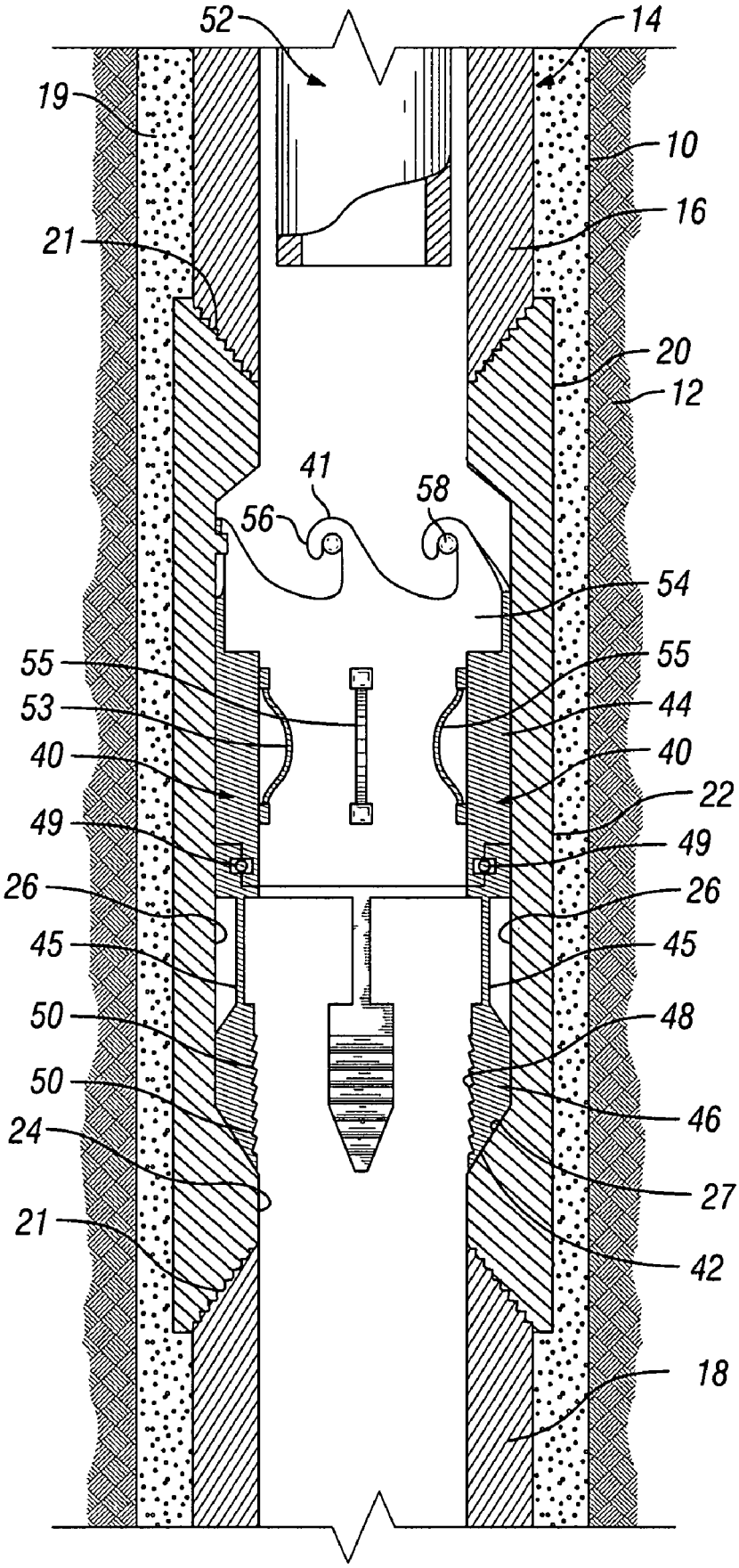
FIG. 1 is a partial cross sectional view of wellbore casing showing one specific embodiment of the casing coupler described herein during run-in of a liner.
Figure 2:
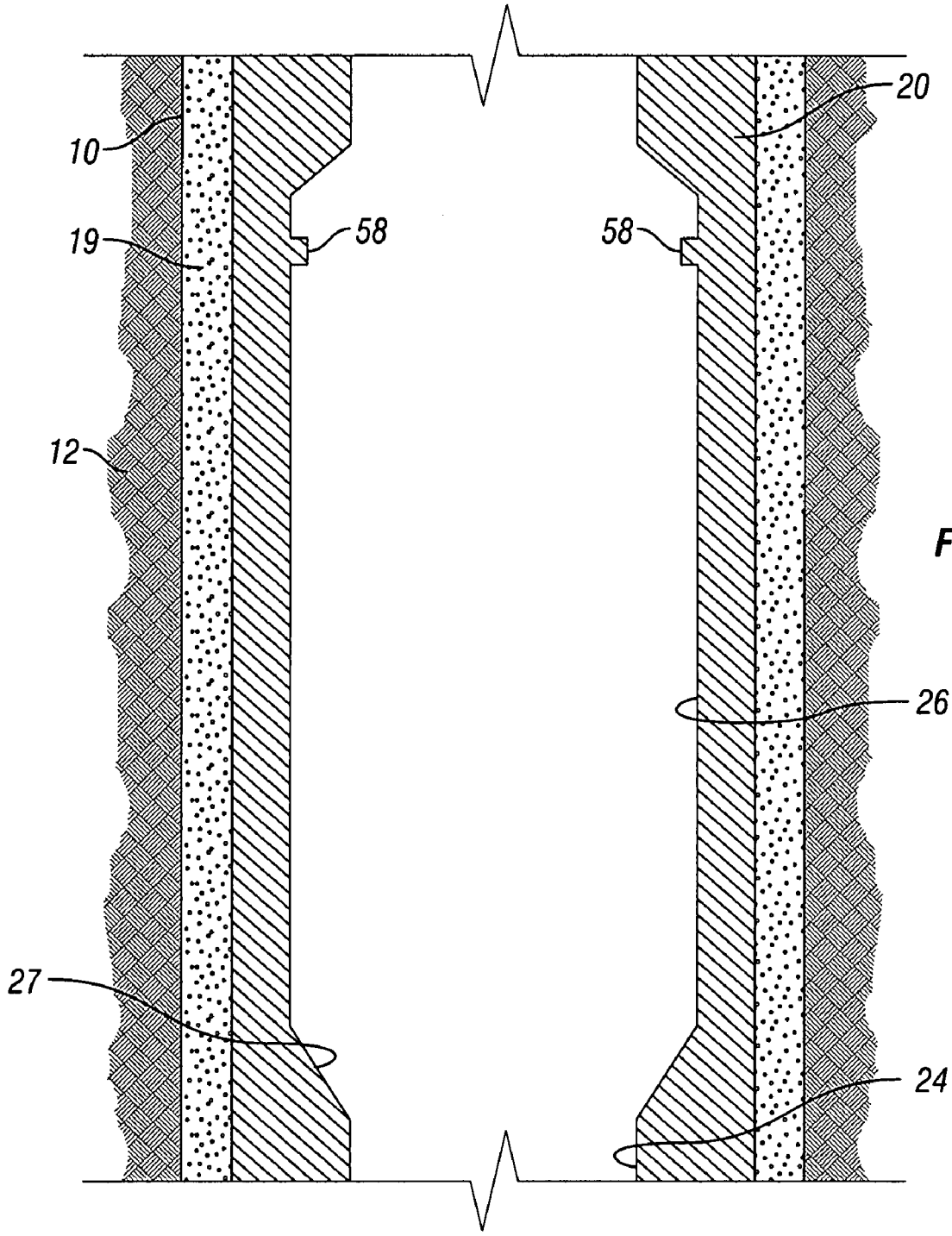
FIG. 2 is an enlarged partial cross-sectional view of the pocket of the casing coupler shown in FIG. 1 without the slip of the coupler disposed therein.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Referring now to FIGS. 1-9, the invention is described broadly with respect to wellbore 10 disposed within formation 12 having casing string or casing 14 disposed therein. Casing string 14 includes upper casing section 16 and lower casing section 18. Upper casing section 16 is supported at its upper end, either directly or indirectly though another piece of casing or by a wellhead assembly. Collar or coupler 20 connects upper casing section 16 with lower casing section 18 using any method or device known to persons of ordinary skill in the art, such as by threads 21. Casing string 14 and coupler 20 are secured within formation 12 by cement 19. Upper casing section 16 and lower casing section 18 have the same inner and outer diameters.

Coupler 20 includes an outer wall surface 22 defining an outer diameter and an inner wall surface 24. Inner wall surface 24 includes recess or pocket 26 defined by an enlarged inner diameter between two smaller inner diameters—one above and one below. Shoulder 27 of pocket 26 is conical.

Slip 40 is disposed within pocket 26 while casing string 14 is being run into formation 12. Slip 40 includes first end 41 and second end 42. Slip first end 41 includes setting mechanism 44 and slip second end 42 includes gripping members 46, each having slip gripping profile 48 for engaging or biting into liner 52 being hung within wellbore 10. Setting mechanism 44 may be a single solid sleeve (FIGS. 1, 3, 4A, 4B, 7-8), a single partial sleeve, or a plurality of partial sleeves separated by vertical slots and disposed circumferentially around pocket 26. Gripping members 45 comprises segments spaced circumferentially apart from each other.

Each gripping member 46 is connected to setting mechanism 44 by connection member 45. The lower ends of gripping members 46 are tapered to mate with shoulder 27. Connection member 45 is a flexible or collapsible thin walled portion of slip 40 whose flexibility or collapsibility facilitates setting of slip 40. Connection member 45 may be a single thin walled sleeve, a single partial thin walled sleeve, or a plurality of thin walled strips or partial sleeves separated by vertical slots so that each setting mechanism 44 is connected to a different gripping member 46.

Gripping profile 48 may have wickers or any other configuration that facilitates gripping profile 48 to grip or bite into liner 52 being hung within casing 14. For example, gripping profile 48 may include teeth 50. Alternatively, gripping profile 48 may be profiled with grippers formed of carbide or other material, Velcro material, ball bearings, or spray-on grit surfaces, or any other material that facilitates increased friction or provides surface penetration of the gripping profile 48 into liner 52. In a preferred embodiment, gripping profile 48 is curved or concave, having the same curvature as the outer diameter of liner 52. In one specific embodiment, gripping profile 48 is a cam surface causing a camming motion against liner 52 to facilitate securing liner 52 to wellbore casing 14.

Initially, slip 40 is fully recessed within pocket 26. Because the components of slip 40 are retained within pocket 26 of casing coupler 20, the gap between the exterior of liner 52 and the interior of casing string 14 can be quite small. For example, in a casing string made up of 35.3 lb., casing sections with an external diameter of 5 inches, an interior diameter of 4.126 inches would be available. Thus, it would be possible to insert liner 52 having a diameter approximating 4 inches, rather than a smaller diameter liner such as one having a diameter of 2⅞ inches. As mentioned above, the use of a larger diameter liner 52 is desirable for two reasons. First, the resulting available cross-sectional flow and work bore area of liner 52 will be larger. Second, gripping members 46 of slip 40 can be more easily and securely held against the larger diameter liner 52.

Setting mechanism 44 comprises liner engagement member 53, shown in FIGS. 1, 3, 4A, 4B, and 7-8 as bow springs 55 which are known to persons of ordinary skill in the art. Generally, bow springs 55 are inwardly biased members that and may be secured to the inner diameter wall of setting mechanism 44 through any device or method known to persons of ordinary skill in the art. Additionally, one or both ends of bow springs 55 may be secured to the inner diameter wall of setting mechanism 44. Bow springs 55 provide inwardly directed force for engaging and securing liner 52 through frictional force.

Figure 3:
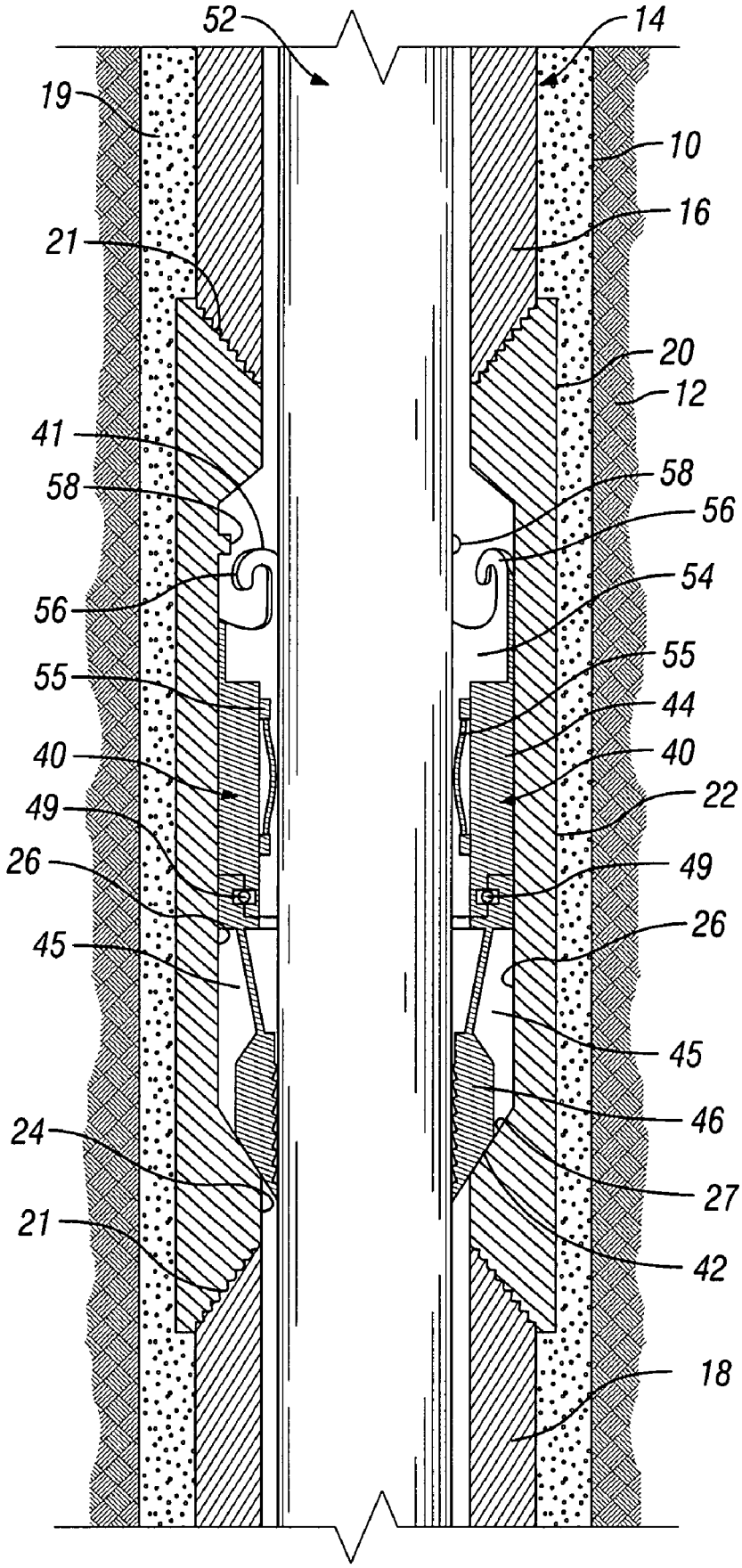
FIG. 3 is a partial cross-sectional view of the wellbore casing of FIG. 1 showing the casing coupler of FIG. 1 in the set position.

Setting mechanism 44 also comprises releasable latching mechanism 54. Releasable latching mechanism 54 allows slip 40 to remain connected to pocket 26 until it is time for slip 40 to be moved from the run-in position (FIGS. 1, 4A, and 7) to the set position (FIGS. 3, 4B, and 8). In the embodiment shown in FIGS. 1-3, releasable latching mechanism 54 comprises J-hooks 56 that are releasably connected to pegs 58 that are circumferentially disposed around the inner diameter of pocket 26.

During operation of this embodiment, liner 52 is lowered into casing string 14 and through the bore of slip 40 until it reaches its desired location. Bow springs 55 engage the outer wall surface of liner 52 as liner is moved downward. After liner 52 is properly located, liner 52 is lifted slightly so that J-hooks 56 are lifted off of pegs 58. Liner 52 is able to remain engaged with bow springs 55 during this operation because there is insufficient downward force on J-hooks 56, whereas, during run-in, pegs 58 provide sufficient upward force to overcome the frictional force between liner 52 and bow springs 55 during run-in and to prevent setting mechanism 44 and, thus, bow-springs 55 from moving downward.

After J-hooks 56 are lifted off of pegs 58, liner 52 is rotated a slight increment to clear pegs 58 from J-hooks 56. Once cleared, liner 52 is lowered downward. As a result, slip 40, setting mechanism 44, connection member 45, and gripping member 46 are also moved downward causing gripping members 46 to slide down shoulder 27 to move inwardly to engage the outer wall surface of liner 52 and to secure liner 52 within coupler 20 (FIG. 3). The weight of liner 52 maintains slips 40 in the set position. It is noted, however, that upon lifting the liner upward, the weight acting downward on slip 40 is decreased such that liner 52 may be lifted. Alternatively, liner 52, once set, could be cemented in place. Liner 52 may be run in on a running string that is retrieved from liner 52. A seal (not shown) may be installed between liner 52 and casing 14.

Figure 4A:
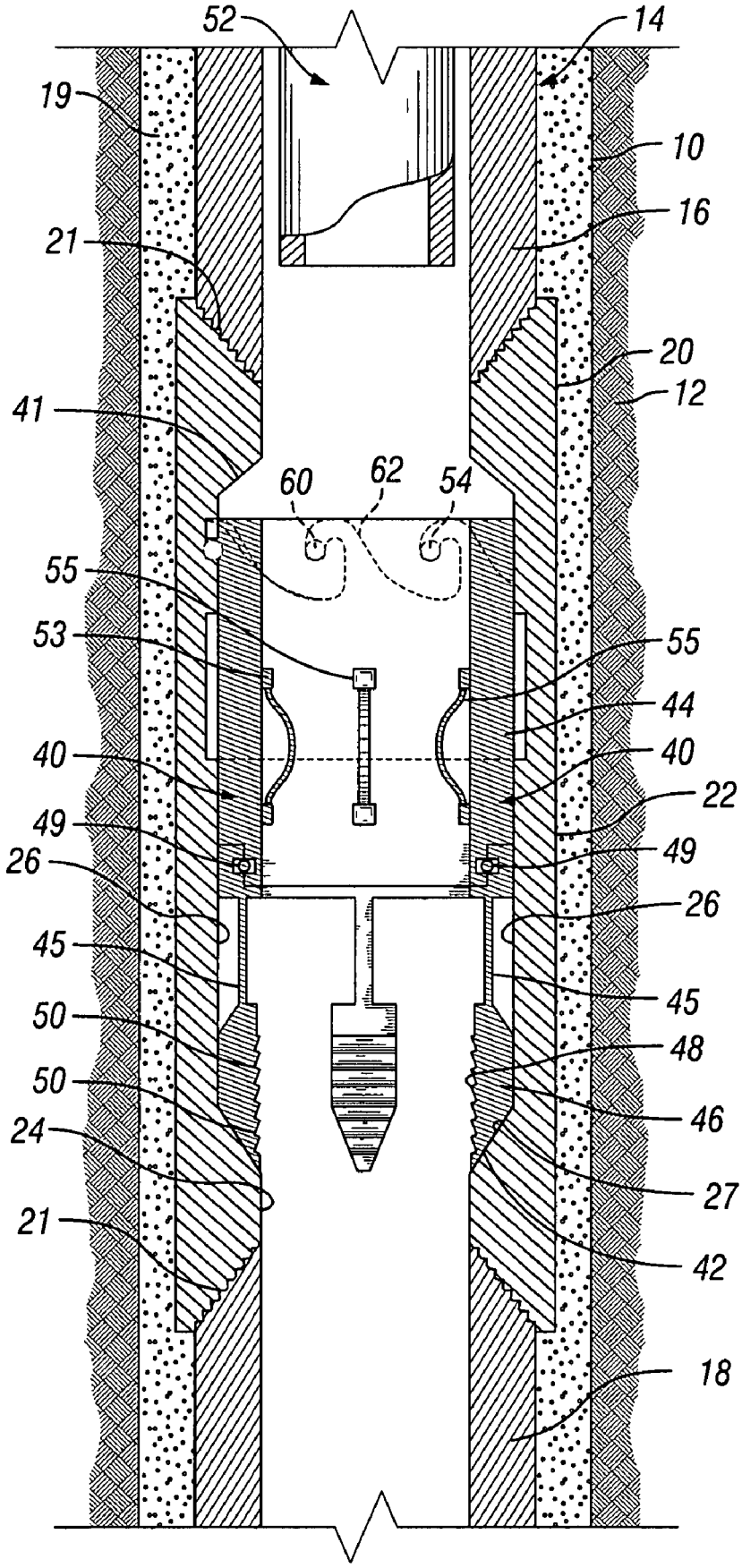
FIG. 4A is a partial cross sectional view of wellbore casing showing another specific embodiment of the casing coupler described herein during run-in of a liner.
Figure 4B:
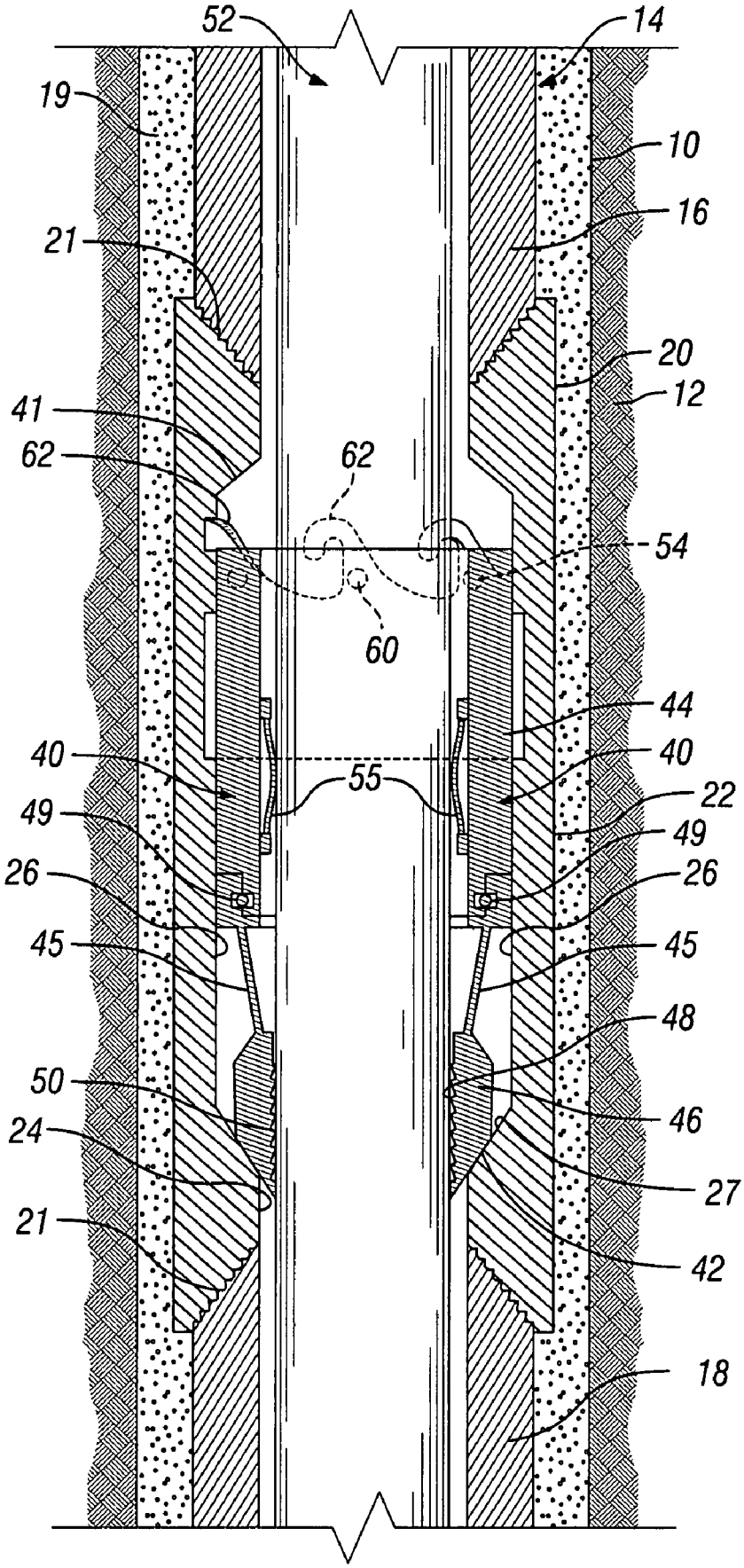
FIG. 4B is a partial cross-sectional view of the wellbore casing of FIG. 4A showing the casing coupler of FIG. 4A in the set position.
Figure 5:
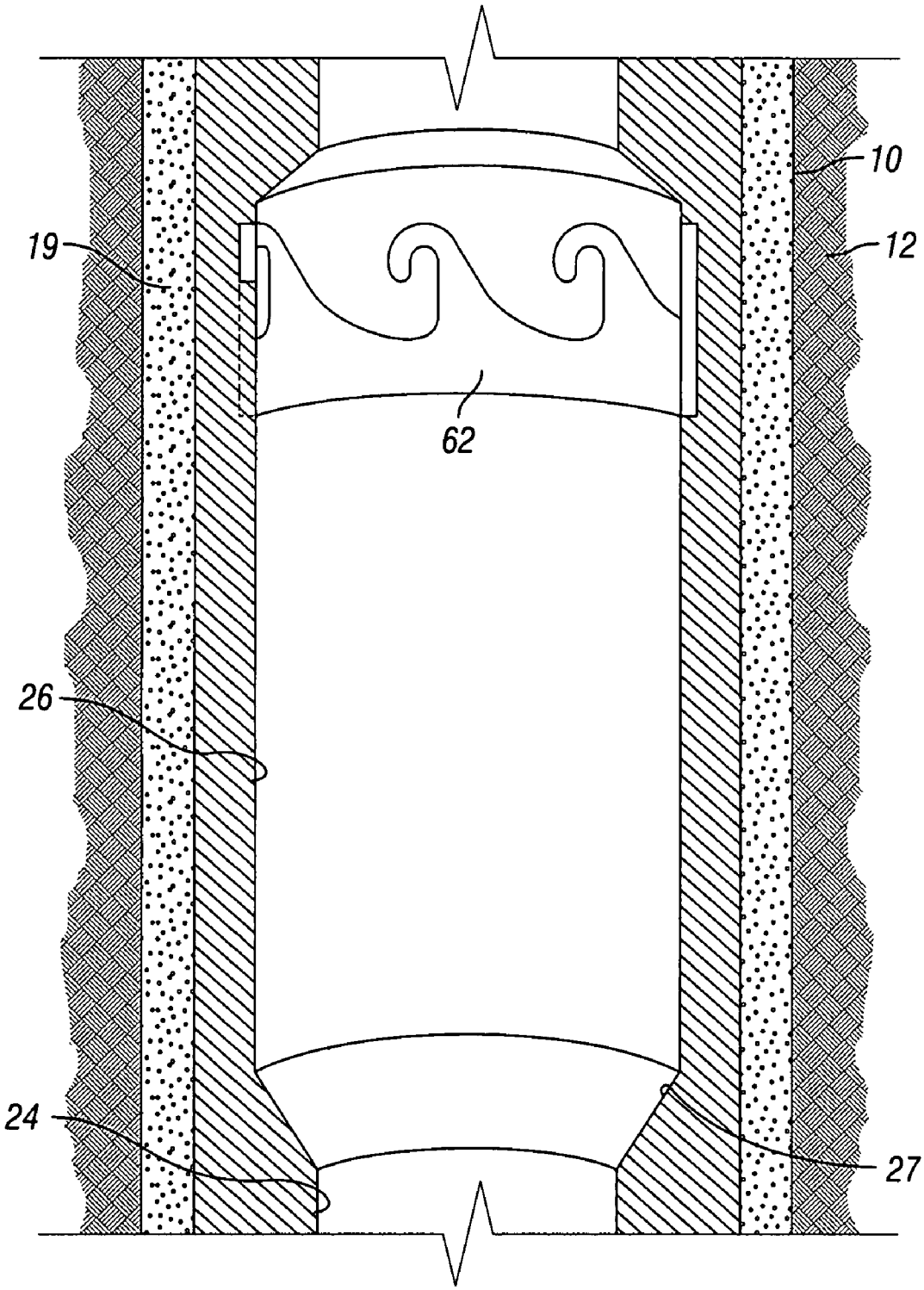
FIG. 5 is an enlarged partial cross sectional view of the pocket of the casing coupler shown in FIG. 4A without the slip of the coupler disposed therein.

In the embodiment shown in FIGS. 4A, 4B, and 5, releasable latching mechanism 54 includes outward protruding pegs 60 that releasably engage J-hooks 62 that are circumferentially disposed around the inner diameter of pocket 26. J-hooks 62 may be attached to the inner diameter of pocket 26, and thus, raised inward from the inner diameter of pocket 26. Alternatively, J-hooks 62 may be "J-hook slots" that are machined or profiled into the inner diameter of pocket 26 while pegs 60 are mounted to latching mechanism 54. As shown in FIGS. 4A, 4B, and 5, J-hooks 62 are J-hook slots. As used herein, the term "J-hook arrangement" includes J-hooks such as J-hooks 56 and J-hooks 62 (if attached and raised inward from inner diameter of pocket 26) as well as J-hook slots 62 shown in FIGS. 4A, 4B, and 5. Operation of this embodiment is the same as the embodiment shown in FIGS. 1-3, except that after liner 52 is properly located, liner 52 is lifted slightly so that pegs 60 are lifted and rotated out of J-hook slots 62.

Figure 6:
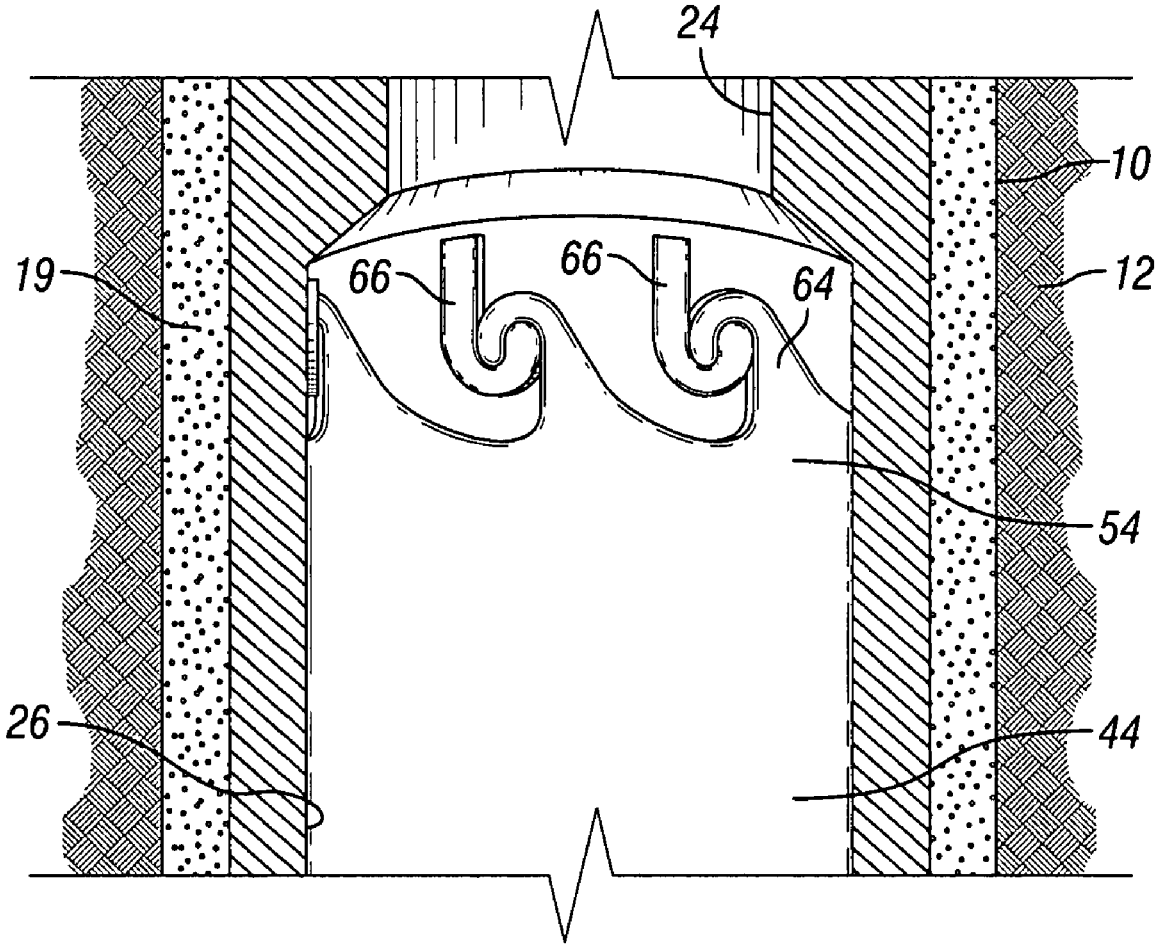
FIG. 6 is an enlarged partial cross sectional view of another embodiment of the pocket of a casing coupler described herein.

In still another embodiment illustrated in FIG. 6, releasable latching mechanism 54 comprises mating J-hooks 64, 66, with J-hooks 64 disposed on releasable latching mechanism 54 and J-hooks 66 being circumferentially disposed around and formed or attached to, and thus raised inwardly from, the inner diameter of pocket 26. J-hooks 66 may also be J-hook slots machined or profiled into the inner diameter of pocket 26. It is to be understood that J-hooks 64, 66 (and J-hook 64 and J-hook slots 66) of this embodiment are also included within the term "J-hook arrangement." Operation of this embodiment is the substantially the same as the embodiments shown in the preceding figures, except that after liner 52 is properly located, liner 52 is lifted slightly so that J-hooks 64 are lifted and rotated out of J-hooks 66.

Preferably, slip 40 of the embodiments shown in FIGS. 1-3, 4A, 4B, and 5-6 includes bearings 49 disposed between an upper portion of setting mechanism 44 and a lower portion of setting mechanism 44. Bearings 49 permit upper portion of setting mechanism 44 to rotate such that as releasable latching mechanism 54 is being actuated, and setting mechanism 44 is being released from pocket 26, gripping members 46 are not being moved, which may otherwise damage or impede setting of gripping members 46.

Figure 7:
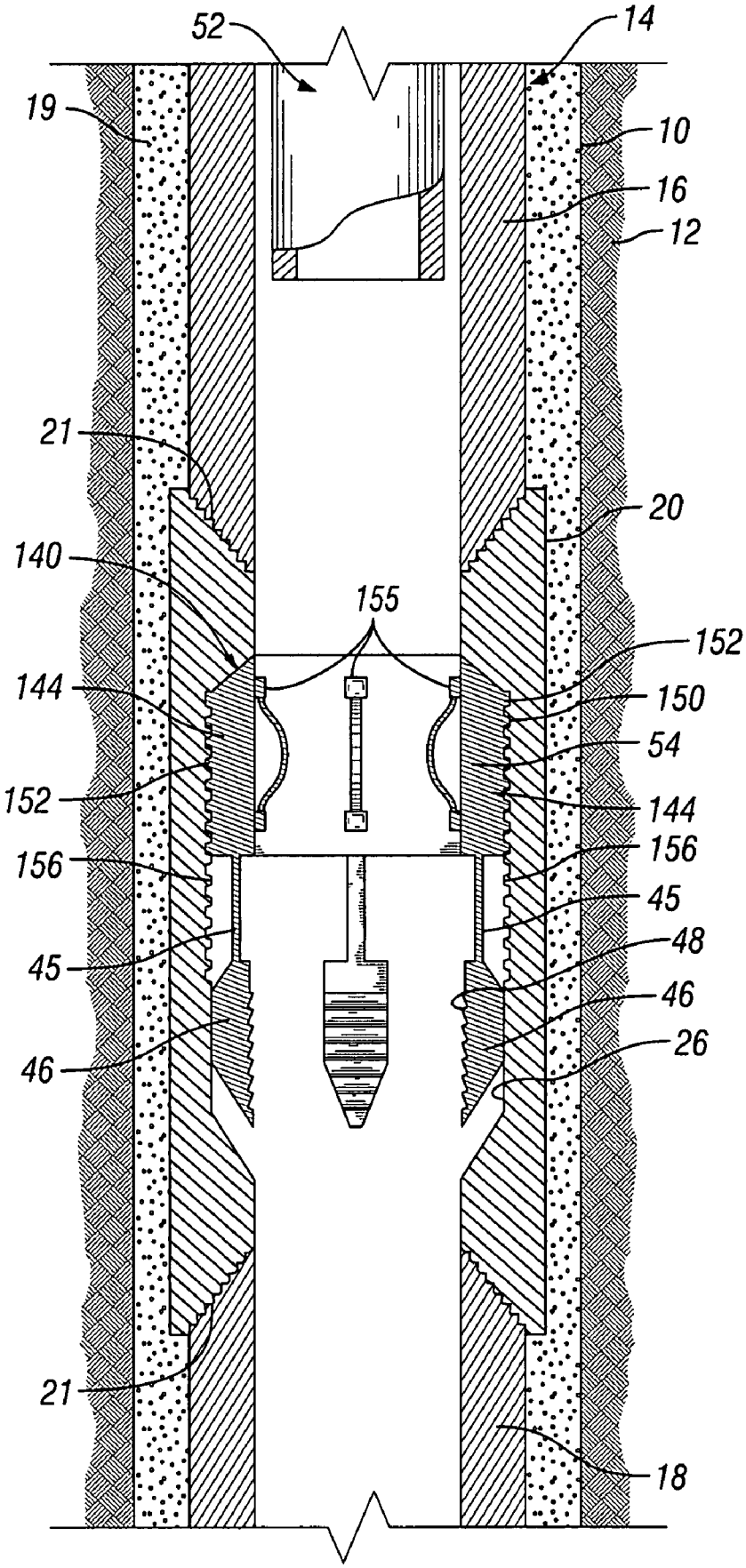
FIG. 7 is a partial cross sectional view of wellbore casing showing an additional specific embodiment of the casing coupler described herein during run-in of a liner.
Figure 8:
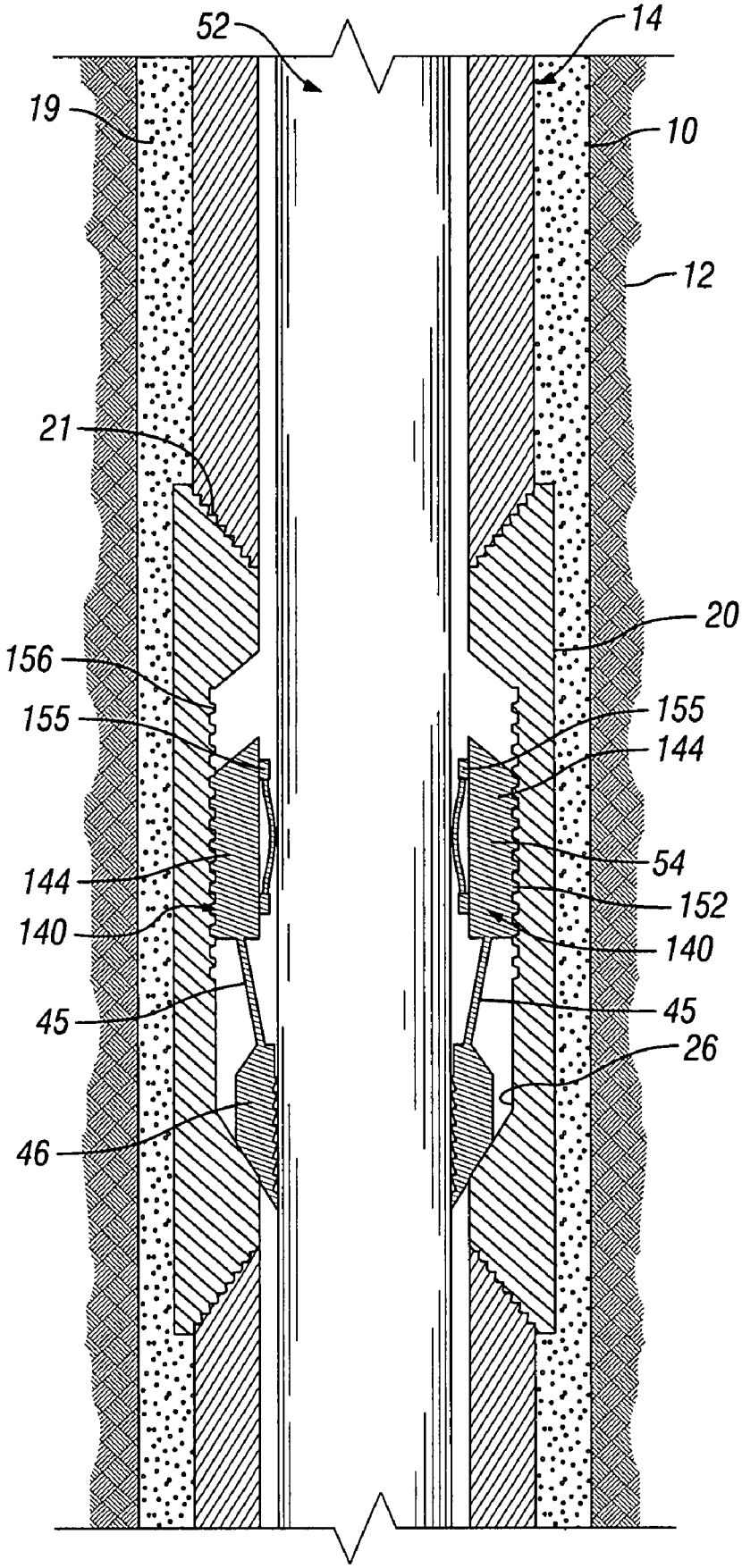
FIG. 8 is a partial cross-sectional view of the wellbore casing of FIG. 7 showing the casing coupler of FIG. 7 in the set position.

Referring now to FIGS. 7-8, in yet another embodiment, setting mechanism 144 comprises liner engagement member, e.g., bow springs 155, releasable latching mechanism 54 having an outer wall surface 150 with external helical threads 152. Internal helical threads 156 are formed on the interior of pocket 26 for receiving external helical threads 152. Thus, external and internal threads 152, 156 are inter-engaged with one another in a well-known manner such that rotation of setting mechanism 144 within casing coupler 20 will move slip 140 axially within coupler 20.

In FIG. 7, slip 140 is in an unset, initial position and in FIG. 8 slip 140 is in its set position. During setting of the embodiment shown in FIGS. 7-8, liner 52 is run-in casing string 14 and through the bore of slip 140. The outer wall surface of liner 52 engages bow springs 155. The inward biased force of bow springs 155 provides sufficient frictional force so that liner 52 is secured rotationally with respect to setting mechanism 144 and rotation of liner 52 causes setting mechanism 144 to rotate. As a result, rotating liner 52 from the surface of the well causes setting mechanism 144 to rotate and to move downward through threads 152, 156. As liner 52 is rotated at the surface to cause slip 140 to move axially downward with respect to casing coupler 20, gripping member 146 is forced radially inward causing gripping member 146 to engage, bite, or cam into the outer radial surface of liner 52. The inward compressive force exerted by gripping member 146 upon the outer wall surface of liner 52 is sufficient to prevent counter-rotation of liner 52 within casing string 14 that might cause slip 140 to become unset.

Figure 9:
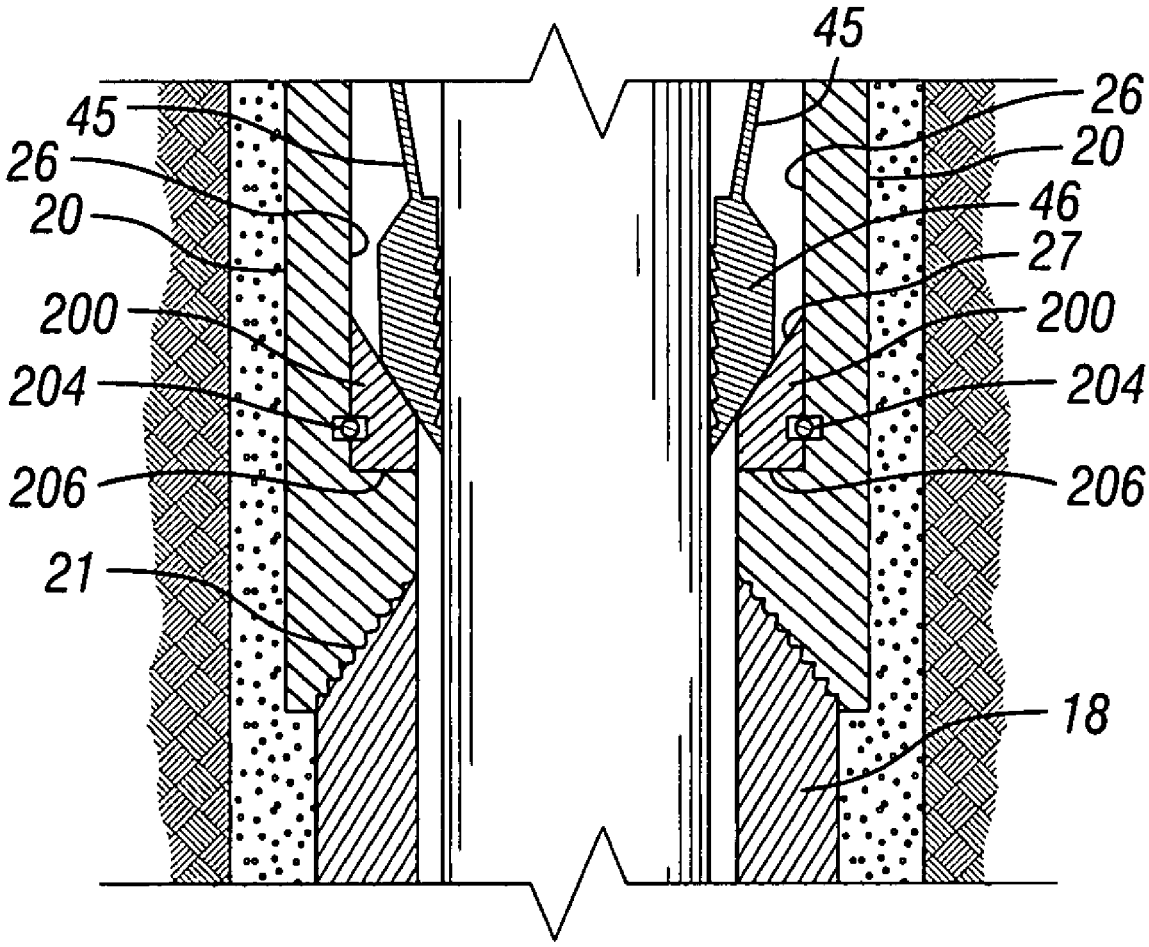
FIG. 9 is an enlarged partial cross-sectional view of an additional specific embodiment of the casing coupler described herein in the set position.

Referring now to FIG. 9, casing coupler 20 can be designed in accordance with any of the preceding embodiments, however, casing coupler 20 of this embodiment includes conically shaped rotating member 200 and bearings 204. Rotating member 200 incorporates shoulder 27 along its upper end to provide its conical shape. Rotating member 200 rests on shoulder 206. Bearings 204 are disposed between an outer wall surface of rotating member 200 and an inner wall surface of pocket 26. Bearings 204 permit rotation of liner 52 after liner 52 is set within casing coupler 20. Such rotation of liner 52 after being set is occasionally desirable during cementing. The amount of rotation of liner 52 within rotating member 200 may be limited or unlimited. In other words, the amount of rotation of liner 52 within rotating member 200 can be limited, for example, to 45 degrees, 90 degrees, 180 degrees, 270 degrees or, can be permitted to rotate more than 360 degrees.

It is to be understood that the invention is not limited to the exact details of construction, operation, exact materials, or embodiments shown and described, as modifications and equivalents will be apparent to one skilled in the art. For example, the embodiment shown in FIG. 9 is not limited for use in the embodiments described in FIGS. 1-8. Instead, the embodiment of FIG. 9 can be used with any liner hanger currently known or hereafter known by persons of ordinary skill in the art. Accordingly, the invention is therefore to be limited only by the scope of the appended claims.

What is claimed is:

1. A liner hanger for hanging a liner within a bore of a casing string, the liner hanger comprising:

a housing for securing into the casing string at a desired location, the housing having an inner wall surface, the inner wall surface having a pocket disposed thereon;

a slip disposed within the pocket, the slip having an inner gripping surface;

a setting mechanism mounted to the slip, the slip being movable from an upper position fully recessed within the pocket to a lower position wherein the inner gripping surface protrudes inward from the pocket; and a liner engagement member mounted to the setting mechanism and protruding inward from the pocket, the liner engagement member frictionally engaging the liner as the liner is lowered through the setting mechanism causing the slip to move downward and inward to the lower position in engagement with the liner.

2. The liner hanger of claim 1, wherein the liner engagement member comprises at least one bow spring having an inward bias.

3. The liner hanger of claim 1, wherein the setting mechanism comprises a tubular body having a helical thread matingly engaged with a pocket helical thread disposed on an inner wall surface of the pocket such that rotation of the liner rotates the setting mechanism to move the slip downward.

4. The liner hanger of claim 1, wherein the setting mechanism comprises a releasable latching mechanism for retaining the setting mechanism in the upper position until the releasable latching mechanism is actuated to release the setting mechanism.

5. The liner hanger of claim 4, wherein the releasable latching mechanism comprises a J-hook arrangement disposed between the setting mechanism and the pocket such that lifting and rotating the liner while the liner is engaged with the liner engagement member causes the J-hook arrangement to disengage.

6. The liner hanger of claim 1, wherein the pocket has a conical shoulder at its lower end, the slip sliding on the conical shoulder when moving form the upper to the lower position.

7. The liner hanger of claim 1, the liner hanger further comprising a deformable connection member connected between the slip and the setting mechanism, the deformable connection member spacing the slip at a first distance from the setting mechanism while in the upper position and at a second distance that is shorter than the first distance while in the lower position.

8. The liner hanger of claim 1, the liner hanger further comprising a rotating member disposed at a lower end of the pocket, wherein the rotating member allows the liner to rotate when the slip is in the lower position.

9. A well comprising:

a string of casing cemented in the well;

a housing secured in the string of casing, the housing having an annular pocket of greater inner diameter than an inner diameter of the string of casing, the pocket having a lower tapered end;

a slip assembly carried in the pocket, the slip assembly having an initial position defining an inner diameter at least equal to the inner diameter of the casing, the slip assembly having an inner gripping surface;

a setting mechanism mounted in the pocket to the slip assembly, the setting mechanism retaining the slip assembly in the initial position, the setting mechanism comprising a liner engagement member and a releasable latching mechanism, the liner engagement member defining an inner diameter less than the inner diameter of the casing, the releasable latching mechanism having an engaged position in which the slip assembly is unable to move downward and a disengaged position in which the slip assembly is permitted to move downward;

a liner lowered into the casing, the liner being engaged with the liner engagement member through a frictional force sufficient, such that manipulation of the liner in a selected manner moves the releasable latching mechanism to the disengaged position, allowing the slip assembly to move downward with the liner to a set position on the tapered lower end with the inner gripping surface engaging the liner.

10. The well of claim 9, wherein the setting mechanism comprises a tubular body having a helical thread disposed on an outer wall surface, the helical thread being matingly engaged with a pocket helical thread disposed on the inner wall surface the pocket, such that rotation of the liner in the selected manner rotates the setting mechanism to move the slip downward.

11. The well of claim 9, wherein the releasable latching mechanism comprises at least one J-hook for receiving at least one peg disposed circumferentially on an inner wall surface of the pocket, the releasable latching mechanism being actuated by lifting and rotating the liner in the selected manner while the liner is engaged with the liner engagement member.

12. The well of claim 9, wherein the releasable latching mechanism comprises at least one peg matingly engageable with at least one J-hook disposed circumferentially on an inner wall surface of the pocket, the releasable latching mechanism being actuated by lifting and rotating the liner in the selected manner while the liner is engaged with the liner engagement member.

13. The well of claim 9, wherein the releasable latching mechanism comprises a first J-hook matingly engageable with a second J-hook disposed circumferentially on an inner wall surface of the pocket, the releasable latching mechanism being actuated by lifting and rotating the liner in the selected manner while the liner is engaged with the liner engagement member.

14. The well of claim 9, wherein the liner engagement member comprises at least one bow spring having an inward bias.

15. A method of securing a liner within a bore of a casing string disposed in a wellbore, the method comprising the steps of:

(a) disposing within a wellbore at least two sections of casing secured together by a casing coupler to form the casing string, the casing coupler comprising a housing having a pocket disposed on an inner wall surface of the housing, the pocket having at least one slip, and a setting mechanism operatively associated with the slip;

(b) lowering a liner into the bore of the casing string;

(c) frictionally engaging an outer wall surface of the liner with the setting mechanism; then (d) lowering the liner causing the setting mechanism and the slip to move downward and the slip to move inward from the pocket until the slip engages an outer wall surface of the liner and, thus, secures the liner within the casing string of the wellbore.

16. The method of claim 15, wherein step (a) comprises retaining the setting mechanism in an initial position; and after step (c) and before step (d), manipulating the liner in a selected manner to release the setting mechanism from the initial position.

17. The method of claim 16, manipulating the liner comprises lifting the liner and rotating the liner an increment less than one 360 degree rotation.

18. The method of claim 16, wherein manipulating the liner comprises rotating the liner less than 360 degrees.

19. The method of claim 16, wherein manipulating the liner comprises rotating the liner more than 360 degrees.

20. The method of claim 19, wherein the liner is rotated two or more rotations, each rotation comprising 360 degrees.

* * * * *